United States Patent [19]

Facius

[11] 4,309,032

[45] Jan. 5, 1982

[54] TENNIS TRAINING DEVICE

[76] Inventor: Walter P. Facius, 124 Second Ave., New York, N.Y. 10003

[21] Appl. No.: 42,050

[22] Filed: May 24, 1979

[51] Int. Cl.[3] ..... A63B 61/00

[52] U.S. Cl. ..... 273/29 A; 273/376

[58] Field of Search ..... 273/29 A, 184 R, 185 R, 273/181 J, 102.2 S, 102.4, 102.1 R, 102.2 B, 26 A, 102.2 R, 102.2 A, 371, 374, 375, 376; 73/379; 124/51 A, 73

[56] References Cited

U.S. PATENT DOCUMENTS

| | | | |
|---|---|---|---|
| 2,087,575 | 7/1937 | Littell et al. | 273/29 A |
| 2,657,931 | 11/1953 | Burrell | 273/26 A |
| 3,133,733 | 5/1964 | Elseroad | 273/26 A |
| 3,254,433 | 6/1966 | Saile, Jr. et al. | 273/374 |
| 3,508,752 | 4/1970 | Lemon | 273/102.2 R |
| 3,874,664 | 4/1975 | Faurot et al. | 273/29 A |
| 3,970,310 | 7/1976 | Gryschuck | 273/102.2 R |
| 3,989,246 | 11/1976 | Brown | 273/29 A |
| 3,993,306 | 11/1976 | Scott | 273/29 A |
| 4,070,018 | 1/1978 | Hodges | 273/29 A |
| 4,116,437 | 9/1978 | Johnson | 273/29 A |

FOREIGN PATENT DOCUMENTS

| | | | |
|---|---|---|---|
| 418878 | 3/1947 | Italy | 273/371 |

*Primary Examiner*—Richard C. Pinkham
*Assistant Examiner*—T. Brown
*Attorney, Agent, or Firm*—Pasquale A. Razzano

[57] ABSTRACT

A tennis training device includes a rigid backboard and a pair of laterally spaced rigid target areas mounted on the backboard. Detection apparatus is provided for detecting impact on the target areas, which detection apparatus is selectively activated in accordance with a predetermined sequence in order to require the player to control movement of a ball rebounding from the backboard and target areas from one activated target area to another.

3 Claims, 6 Drawing Figures

TENNIS TRAINING DEVICE

The present invention relates to tennis training aids and, more particularly, to a device for accelerating the learning of basic tennis skills.

A variety of different types of tennis training devices have been proposed to aid tennis players in improving their game. Perhaps the simplest form of tennis training aid is a vertical backboard or wall having a net line painted on it and against which the player may hit a tennis ball for practice purposes. Some of these fixed backboard structures also have an upper limit line to represent a simulated base line, in order to induce the players to hit the ball above the net line but below the upper limit or base line.

In more recent years more sophisticated training aids have been developed which provide target areas towards which the player attempts to hit the ball. For example, U.S. Pat. No. 4,116,437 discloses a target area having a plurality of vertically positioned zones against which a ball thrown from an automatic ball throwing machine is returned by the player. Each zone has a different value, and the target game accumulates a player's score over a period of time based on the number of serves returned to the different zones. This device does not enable a player to practice positioning of the ball during play of a game, since it is basically a serve and return type of device.

Another similar device is shown in U.S. Pat. No. 3,993,306 wherein a frame work is provided above a net on a tennis court, with vertically positioned strips that define target openings through which the player attempts to hit the ball during a serve or volley.

U.S. Pat. Nos. 3,989,246 and 4,070,018 disclose other forms of target practice games in which a ball is automatically served to a player who returns it against a flexible net which may have target areas defined thereon. In neither of these devices is the ball returned to the player in order to permit a volley to continue, or to permit the player to practice control of the ball. Basically, these also are serve and return devices.

Another tennis aid, for practicing a tennis serve, is shown in U.S. Pat. No. 3,874,664 wherein a pressure sensitive pad is placed on the tennis court, and the player attempts to hit the pad with his serve. When the pad is hit a signal is produced representing impact, and a counter may be provided to keep track of the player's score.

In distinction to such previously proposed tennis practice aids, the present invention provides a device which enables a tennis player to rapidly achieve and maintain a high level of accuracy and control in hitting a tennis ball against a backboard in a continuing volley simulating actual play conditions. Basically, the tennis training aid of the invention consists of a backboard having a pair of laterally spaced impact or target areas mounted thereon including means for detecting an impact of the ball on the target area and means for selectively activating the target areas to detect such an impact.

The target areas or target members used in the backboard of the present invention are rigid elements, preferably formed of the same material as the backboard, so that balls hit against the backboard or the target area are returned to the player to be hit again. The target areas are located above the net line and represent the objectives towards which the player must hit the ball.

It is well known by those familiar with the game of tennis that within certain parameters of velocity, height, and top spin, the height at which a ball strikes a backboard is proportional to the distance a ball travels beyond the net. The present invention incorporates these concepts, but differentiates the purpose of the target areas and permits a continuation of play while the location of the target to be hit by the player after rebound of a ball against the backboard varies.

A tennis player exercising good control in handling a rebounding ball increases his chance of moving the ball to an appropriate target area, just as in the play of the game a player exercising good control increases his chances of hitting a winning shot. In accordance with the present invention the lateral disposition of the targets serve to develop the player's anticipation, movement, and stroke coordination by rewarding him when the activated target is struck, as for example, by adding a point to his score, and then forcing him to move the ball to a different target in order to make the next score or point. The pace of this exercise, as dictated by the player's ability, agility, stamina, and finesse in coordinating the exercise, is correlated to an actual tennis game.

In tennis, a player strives to control the pace of the game and when he is ready, goes for a winner. Likewise, with the device of the present invention the player can practice controlling the pace of the game by controlling the rebounding ball and when he is ready he can go for a winner by aiming at the activated target.

In the play of an actual tennis game the fact that an opposing player may return a winner forces the player to control the returned ball and position his shot in order to set up his next winning shot. This can also be practiced with the present invention in that a ball rebounding off the target could be considered a winner, and forces the player to control it in order to set up his own next winning shot in such a way that he can hit the activated target. The consistency and frequency with which a player hits winning shots determines his chances of winning the point. Wasted shots (i.e. shots missing an appropriate target) give the opposing player the opportunity of winning the point. Clearly, a player hitting five winning shots within a given period of time is more likely to win a point than a player hitting three winners within the same period. With the incorporation of a timer in the present invention, the invention encourages winning shots, discourages wasteful shots, provides a good gauge of a player's progress and stimulates a more productive practice. For example, the timer may be set for a one minute period, and the player can gauge his progress by determining how many winning shots he has hit during that one minute period. Alternatively, the apparatus can be set to determine how long it takes for a player to hit a given number of winning shots.

The above, and other objects, features and advantages of this invention will be apparent in the following description of an illustrative embodiment thereof, which is to be read in connection with the accompanying drawings, wherein.

Figure 1:
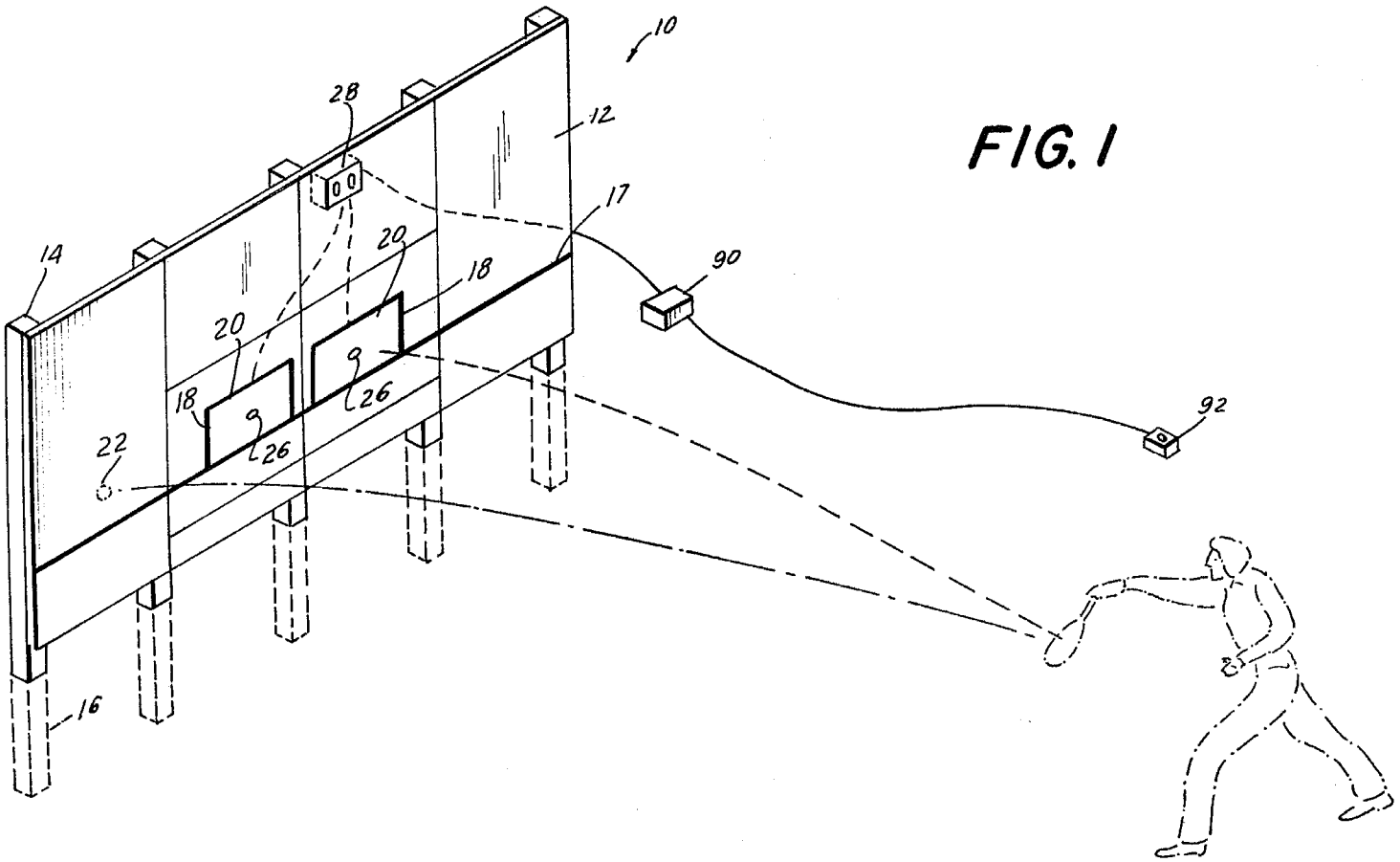
FIG. 1 is a perspective view of the tennis training aid constructed in accordance with the present invention.

Referring now to the drawing and initially to FIG. 1, the tennis training device 10 of the present invention consists of a backboard 12 formed of a rigid material against which a tennis ball can be hit for rebound purposes. Such material may for example consist of ¾" plywood panels. In the illustrative embodiment, four 4'×8' plywood panels are shown mounted on 4'×4' vertical support posts 14, in any convenient manner. The posts serve to hold the backboard in its vertical position and their lower ends 16 are secured in an underground foundation structure in any desired manner. A netline 17 is painted on the backboard panels at the location above the ground at which the top of a normal tennis net would be located.

Backboard 12 has a pair of laterally spaced openings 18 formed therein, in which target members 20 are mounted. Each of the target members includes a sensing device which is capable of detecting an impact of a tennis ball 22 against the target. A control circuit 24 is provided which selectively activates the detecting means of the targets so that only one target is activated at any one time.

Each target includes a light 26, or other signal device, which is activated when the detecting means associated with that target is activated, in order to provide a signal to the player that it is the target member which is activated and towards which the ball must be hit. When an impact against an activated target is made, the impact is recorded on the scoreboard 28 which, in the illustrative embodiment of the invention, is mounted at the upper portion of the backboard. Control circuit 24 includes a built-in timer which keeps the game activated for a predetermined variable period of time, for example one minute, so that the player can determine his progress by noting the increase in his score during successive one minute training intervals.

Figure 2:
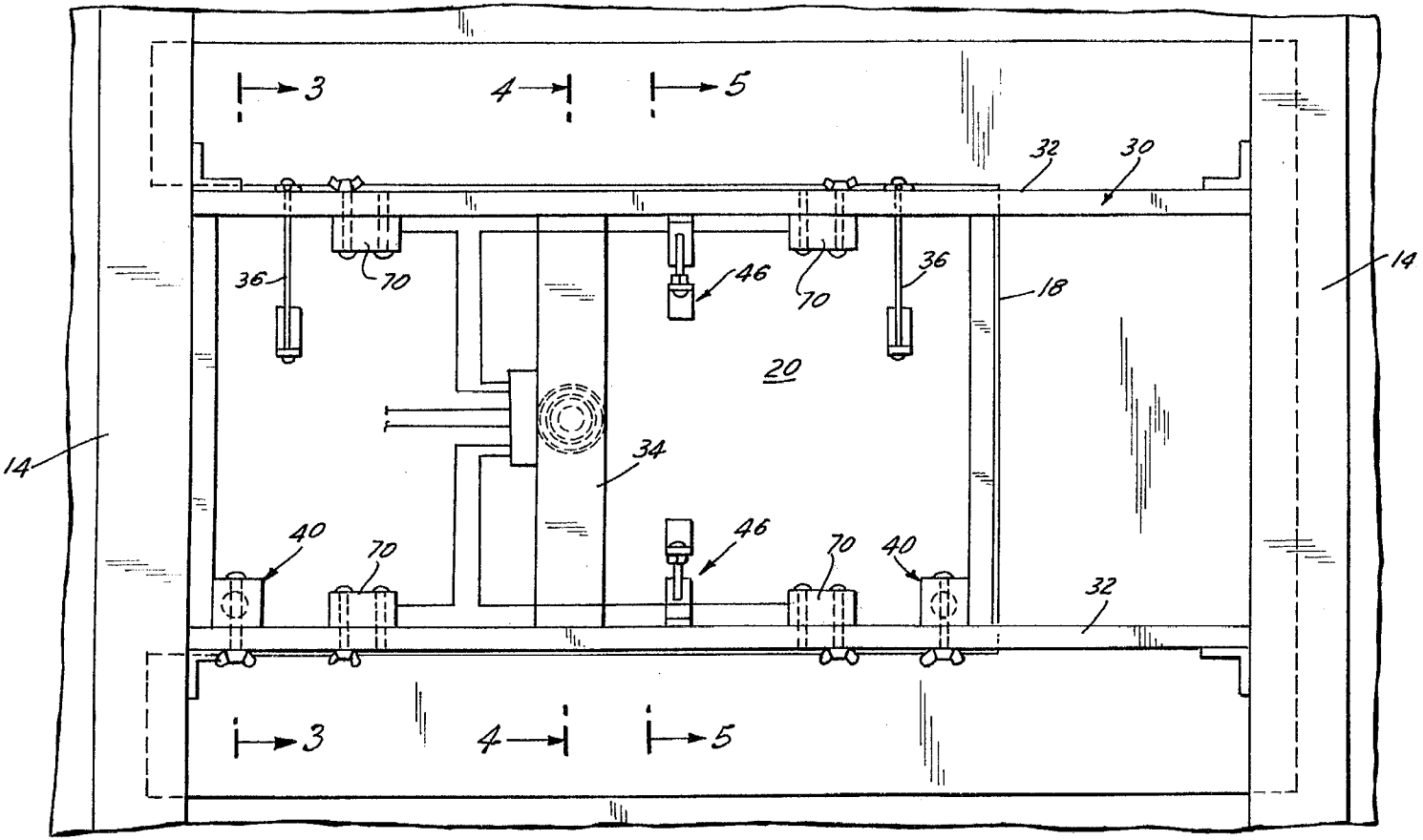
FIG. 2 is a rear view of one of the target areas shown in the backboard of FIG. 1.

Targets 20 are formed of the same type of material as the backboard, preferably ¾" plywood, and are cut to be substantially complementary to and fit within the openings 18. They are movably mounted on associated frameworks 30 supported at the rear of the backboard adjacent openings 18 in the backboard panels of backboard 12. This framework includes a pair of vertically spaced horizontally extending support bars 32 secured between adjacent vertical posts 14 and at least one vertical brace member 34 extending therebetween. Targets 20 are supported on the upper support bar or frame member 32 by flexible resilient metal straps 36. These straps are secured to frame member 32 and to the rear 38 of the target in any convenient manner. As seen in FIG. 2, two such mounting straps 36 are used on each target panel.

Figure 3:
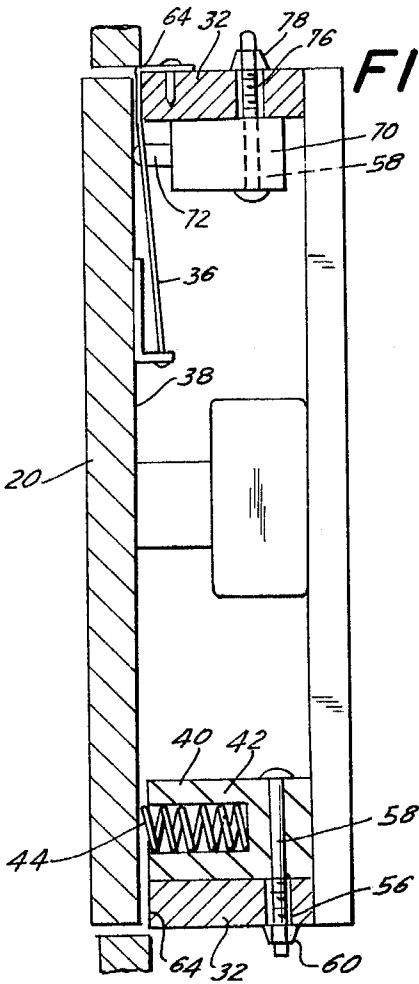
FIG. 3 is a sectional view taken along line 3—3 of FIG. 2.

In order to keep the target panel 20 in a relatively vertical position, a pair of spring biasing units 40 are mounted on the lower frame member 32, as seen in FIGS. 2 and 3. These members each include a housing 42 and a compression spring 44 mounted therein having one end bearing against the lower back surface 38 of the target. The spring urges the bottom of the target member outwardly. Movement of the target member in that direction, under the influence of spring 44, is limited by the motion limiting devices 46, shown in FIG. 5. These devices each include a pair of L-shaped brackets 48,50 respectively mounted on the adjacent frame member 32 and on the rear of target 20 with a bolt 52 mounted in the bracket 48 in position to engage flange 54 of lower angle member 50. Thus movement of target 20 in the direction of arrow A in FIG. 5 is limited by the engagement of bolts 52 and flanges 54.

Figure 5:
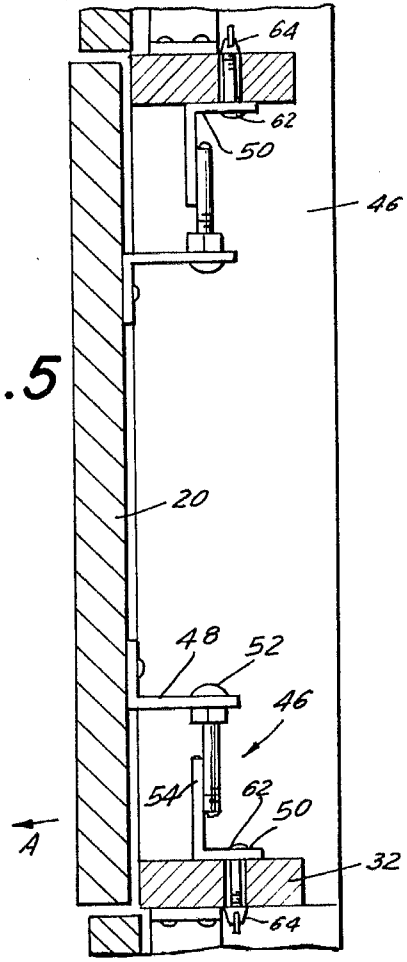
FIG. 5 is a sectional view taken along line 5—5 of FIG. 2.
Figure 4:
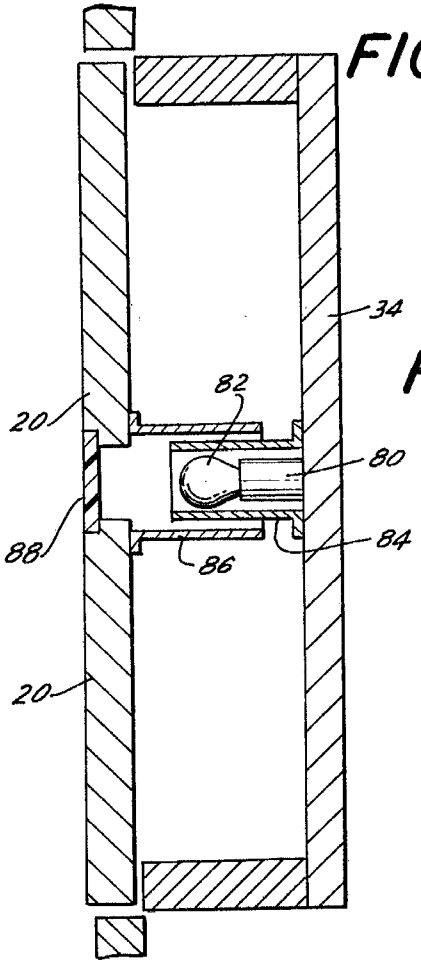
FIG. 4 is a sectional view taken along line 4—4 of FIG. 2.

As seen in FIGS. 3 and 5 spring biasing units 40 and angle members 50 are mounted on frame members 32 to permit lateral adjustment thereof with respect to target 20. That is, the lower frame member 32 has enlarged openings 56 formed therein which receive bolts 58 extending from the spring biasing unit. A wing nut 60 is mounted on the end of bolt 58, so that it can be loosened. When loosened, the position of block 40 can be varied in opening 56, in order to adjust the vertical position of target 20. When the desired vertical position thereof is achieved, wing nuts 60 are tightened to lock the units in place. Similar adjustment of bolts 62 and wing nuts 64 for the angle members 50, will aid in vertical positioning of the targets. Preferably, these elements are adjusted so that the front face of the target member lies in substantially the same plane as the impact area of the backboard surrounding it. Of course, as seen in FIG. 3, movement of the target member is limited between this aligned vertical position as defined by the stop members 46 and an innermost position defined by the front edge 64 of the brace members 32.

The means for detecting impact of a tennis ball against the targets consists of micro-switches 70. Preferably four such micro-switches are located along the back of the target member on frame members 32, as seen in FIG. 2. These micro-switches include contact elements 72 positioned adjacent the back of the target member to be engaged therewith when the target member moves inwardly in response to the impact of a tennis ball. In the normal position, shown in FIG. 3, the contacts just touch the back of the target member, but do not close the switch. The impact of a tennis ball against the target member, even on a light stroke, will depress contact members 72 sufficiently to close at least one of the switches 70.

As with spring units 40, micro-switches 70 are adjustably mounted. Again, a bolt 58 extends through the body of the contact switch and through an enlarged slot 76 formed in the adjacent frame member 32. A wing nut 78 serves to lock the microswitch and through an enlarged slot 76 formed in the adjacent frame member 32. A wing nut 78 serves to lock the micro-switch in place after the position thereof has been adjusted by movement of bolt 58 in the slot 76.

The vertical brace 34 carries a light socket 80 having a bulb 82 mounted therein. A protective cylindrical sleeve 84 may be provided around the bulb and socket, and in turn receives within a telescopically positioned enlarged sleeve 86 secured to the rear of target panel 20. A plastic impact resistant lens 88 is mounted in the front face of the target member in alignment with bulb 82, in any convenient manner. When the bulb 82 is lit, its light is visible through lens 88. In accordance with the invention bulb 82 is lit only when the detecting means or microswitches 70 associated with its panel are activated to detect an impact. Thus the light bulb provides a signal to the player that its target member is the one to be hit with the player's next shot.

Figure 6:
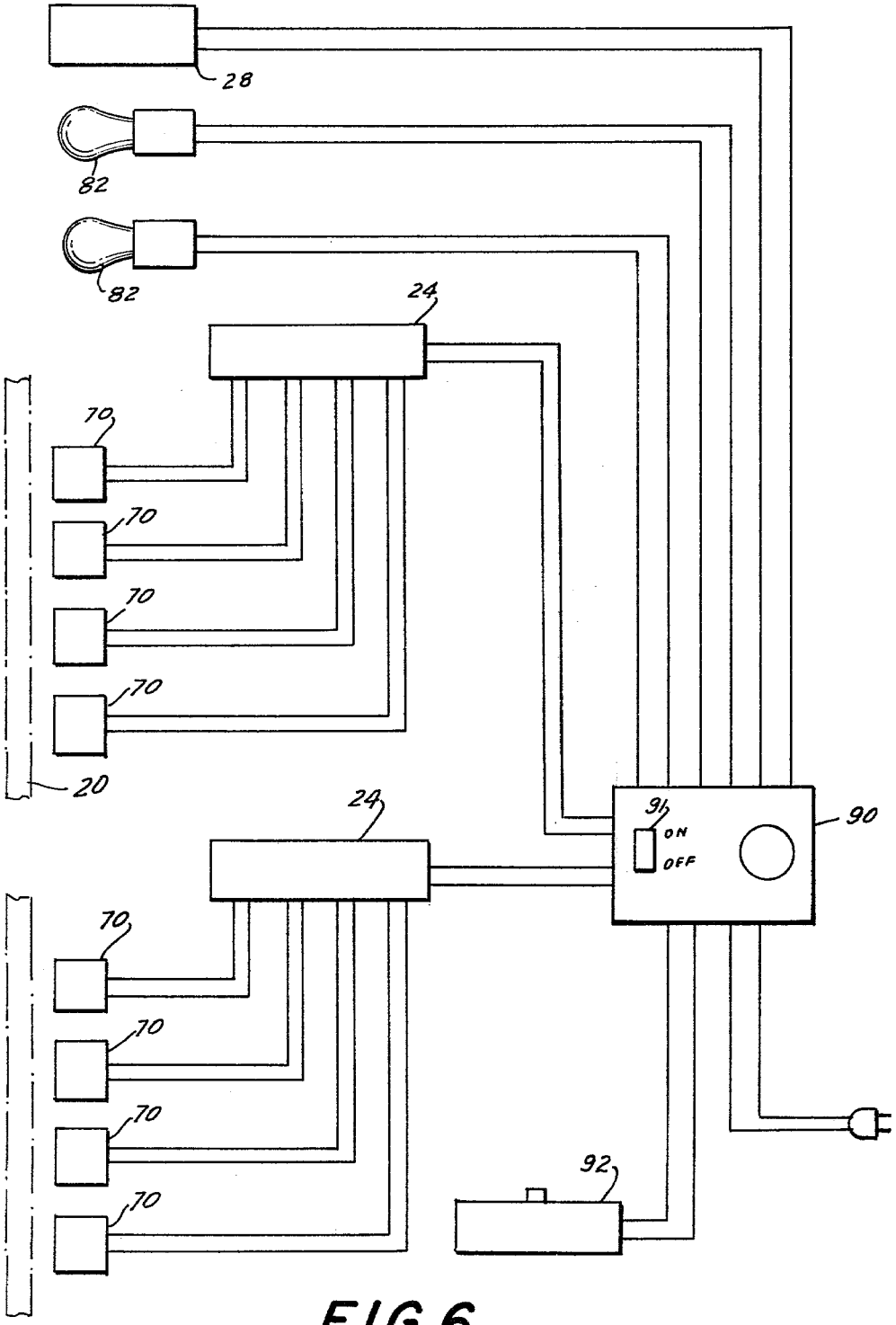
FIG. 6 is a schematic circuit diagram of the control and score-keeping system of the present invention.

FIG. 6 schematically illustrates the control arrangement for the micro-switches, light bulbs, and scoreboard used in accordance with the present invention.

The control arrangement includes a control circuit 90 to which power is supplied from a conventional power source in any convenient manner, which may include an on-off switch 91. The circuit is arranged, in any convenient manner as will be apparent to those skilled in the art, to selectively activate one of the groups of micro-switches 70 associated with the two targets 20. For example, the circuit 90 may have a conventional flip-flop circuit which will activate only one group of micro-switches at a time, and keep that group activated until one of the micro-switches is closed as a result of an impact against the target, at which time the flip-flop will flip over and activate the other group of micro-switches and deactivate the previously activated group. As a result the player must then hit the other panel in order to achieve a new score.

Each impact against a target whose micro-switches are activated produces a signal by the micro-switch through the control circuit 90 to the scoreboard 28, which may simply be a conventional counter device. As a result each signal will increase the score displayed by the scoreboard one unit. At the same time the flip-flop will control the activation of the light bulbs 82 in the same manner, so that each light bulb will be lit only when its associated micro-switches are activated.

A timer is built into the circuit 90, in any convenient manner as would appear to those skilled in the art, so that the entire device is activated for only a predetermined period of time. The timer may be adjustable, so that the player can select the amount of time he wishes to practice. In addition, a reset control button 92 is provided to enable the player to reset the scoreboard to zero when desired and to reset the timer. The timer is activated to count time by the closure of a microswitch in response to the first impact against the activated target area after the device is reset.

With this arrangement the player can activate the device and the target areas 20 will be selectively lit in a predetermined sequence (alternating in this embodiment of the invention) requiring the player to control the placement of the ball and the pace of the play in order to impact the ball against the activated target. The number of impacts achieved during his selected period of time represents his score.

It is to be understood that although a specific method of scoring has been disclosed herein, circuit 90 can be modified as would occur to those skilled in the art to provide for other scoring systems. For example, the circuit can be arranged so that the game continues until a preselected score is achieved, with no time limit shut-off. Similarly, instead of the targets being alternately activated, circuit 90 can be arranged to activate targets 20 in some other predetermined sequence. The sequence can be so arranged or so long that the activation sequence appears to be random.

Additionally, it is to be further understood that although the means for detecting the impact on the target area has been described as including a movable panel member and micro-switches, other detecting means can be provided. For example, a pressure sensitive surface of the backboard can be provided as the detecting device.

Although an illustrative embodiment of the invention has been described, it is to be understood that various changes and modifications can be effected therein without departing from the scope or spirit of this invention.

What is claimed is:

1. A tennis training device comprising a rigid vertical backboard, a pair of laterally spaced rigid target areas mounted on said backboard, each of said target areas including means for detecting an impact thereon, said backboard being vertically positioned to cause balls impacting against the backboard or the target areas to rebound back towards the player after each such impact to enable the player to stroke the same ball a plurality of times in sequence; and means for activating said detecting means associated with each said target areas in accordance with a predetermined sequence to require the player to control movement of a ball rebounding from the backboard or target by stroking the ball back to the activated target area; means for resiliently suspending said rigid target areas in the backboard in a first position whereby the target areas lie substantially in the same plane as the backboard and are permitted to move inwardly of the backboard slightly; said detecting means comprising microswitches mounted on the backboard for contact with their associated target areas upon inward movement of the target area when the target area is hit; means for limiting movement of the target area between said first position and said second innermost position; and said limiting being adjustable so that said first and second positions may be varied.

2. A tennis training device as defined in claim 1 including means for signaling to the player which of the target area detecting means is activated before the player strokes the ball towards the backboard.

3. A tennis training device as defined in claim 2 including means for counting the number of impacts by the player against the activated target areas during a predetermined period of time.

* * * * *